United States Patent [19]

Vander Horst

[11] 4,370,101

[45] Jan. 25, 1983

[54] CONSTANT DELIVERY INERTIA PUMP

[76] Inventor: John Vander Horst, 28153 War Admiral Trail, Evergreen, Colo. 80439

[21] Appl. No.: 178,869

[22] Filed: Aug. 18, 1980

[51] Int. Cl.[3] ..... F04F 7/00

[52] U.S. Cl. ..... 417/241

[58] Field of Search ..... 417/211, 240, 241

[56] References Cited

U.S. PATENT DOCUMENTS 3,617,153 11/1971 Mowry ..... 417/241
3,765,800 10/1973 Foote ..... 417/241

FOREIGN PATENT DOCUMENTS 304135 3/1955 Switzerland ..... 417/240
106989 6/1917 United Kingdom ..... 417/241
130332 7/1920 United Kingdom ..... 417/241

*Primary Examiner*—Richard E. Gluck
*Attorney, Agent, or Firm*—Edwin L. Spangler, Jr.

[57] ABSTRACT

This invention relates to an inertia pump characterized by a fluid-filled loop capable of being oscillated, an outlet connected to receive fluid pumped from the loop, an inlet connected into the loop for delivering fluid thereto, the inlet and loop cooperating with one another to define alternate flow paths to the outlet, flow restricting means located in each of the alternate flow paths responsive to the direction of fluid flow therein and automatically operative to inhibit reverse flow, and means connected to the loop for rapidly oscillating same back and forth substantially in the direction of fluid flow therethrough relative to the environment.

10 Claims, 5 Drawing Figures

CONSTANT DELIVERY INERTIA PUMP

The pump of the present invention is unique if for no other reason than it is so fundamentally simple while, at the same time, remaining capable of delivering a steady stream of pumpable fluid at a relatively uniform rate of flow. While not quite as simple in construction as the siphon, the more basic forms of the instant pump seem more closely allied to the latter than to the various and sundry complicated pieces of equipment that are in use today as the means for transferring fluid from one place to another.

Stripped down to its bare essentials, the pump forming the subject matter of the instant invention requires a fluid flow passage in the form of a loop capable of carrying a pumpable fluid and at least a portion of which is both movable to and fro relative to the fluid contained therein and relative to its surroundings. This loop has an outlet capable of receiving fluid pumped from the loop and delivering same to an appropriate receiver such as a continuation of the loop. Means for introducing fluid into the loop is connected therein at a point where alternate flow paths are established between it and the outlet. Located in each of these alternate flow paths is a flow restrictor of some nature which is responsive to the direction of fluid flow therein and automatically operative to at least inhibit, if not prevent, reverse flow therein. Finally, the pump requires a drive mechanism connected to the loop capable of oscillating at least a portion of it rapidly back and forth in the general direction in which the fluid flows therethrough relative to the environment.

Pumps embodying the foregoing novel features can be divided into two basically different forms although their principle of operation remains essentially the same. In the first of these, an essentially rigid fluid-filled loop or passage is oscillated back and forth about an axis extending more or less perpendicular to the plane thereof. Its axis of oscillatory movement preferably, but not necessarily, is coincident with either the inlet into the loop or the outlet therefrom, or both, since by so doing a simple torsionally flexible connection to one or the other will accommodate the motion while at the same time, eliminating all the need for a dynamic fluid seal.

The other of the two basic embodiments utilizes a fluid-filled loop having at least a portion thereof flexible so as to accommodate the oscillatory motion imparted thereto. In this instance, the inlet and outlet connections may be rigid as well as the means for delivering the pumpable fluid thereto and receiving it therefrom. Here again, the need for dynamic fluid seals is eliminated altogether because the oscillatory motion is completely taken up by the flexion of the loop.

Within these two basic forms of the pump are a miriad of versions all of which define alternate flow paths through the loop between the inlet and the outlet with means for inhibiting reverse flow in each. All that is required in addition to the basic pump mechanism as set forth hereinabove is to have either its inlet or outlet or both connected to a fluid-carrying conduit of some sort where the fluid contained therein becomes effective when flowing to create the differential fluid pressure upstream and downstream of the flow restrictors that is required to actuate them. Generally speaking, any fluid-filled line leading to or from the pump will suffice for this purpose.

It is, therefore, the principal object of the present invention to provide a novel and improved oscillating inertia pump capable of delivering a pumpable fluid at an essentially constant rate.

A second objective is to provide a device of the character described which need have no moving parts in contact with the flowing fluid.

Another object is to provide a pump that can be made totally without seals, packing or other appurtenances subject to leakage.

Still another objective of the invention forming the subject matter hereof is the provision of a pump that is ideally suited for use in the pumping or corrosive, flammable, toxic and other dangerous fluids including those containing a high percentage of suspended solids.

An additional object is to provide a pump that apart from the mechanism used to drive same, virtually has nothing to wear out even during prolonged periods of continuous hard use.

Further objects are to provide a pump which is exceedingly simple, versatile, reliable, relatively inexpensive, compact, lightweight, rugged, easy to install and service, and one that requires no special skills to install.

Other objects will be in part apparent and in part pointed out specifically hereinafter in connection with the description of the drawings that follows, and in which.

Figure 1:
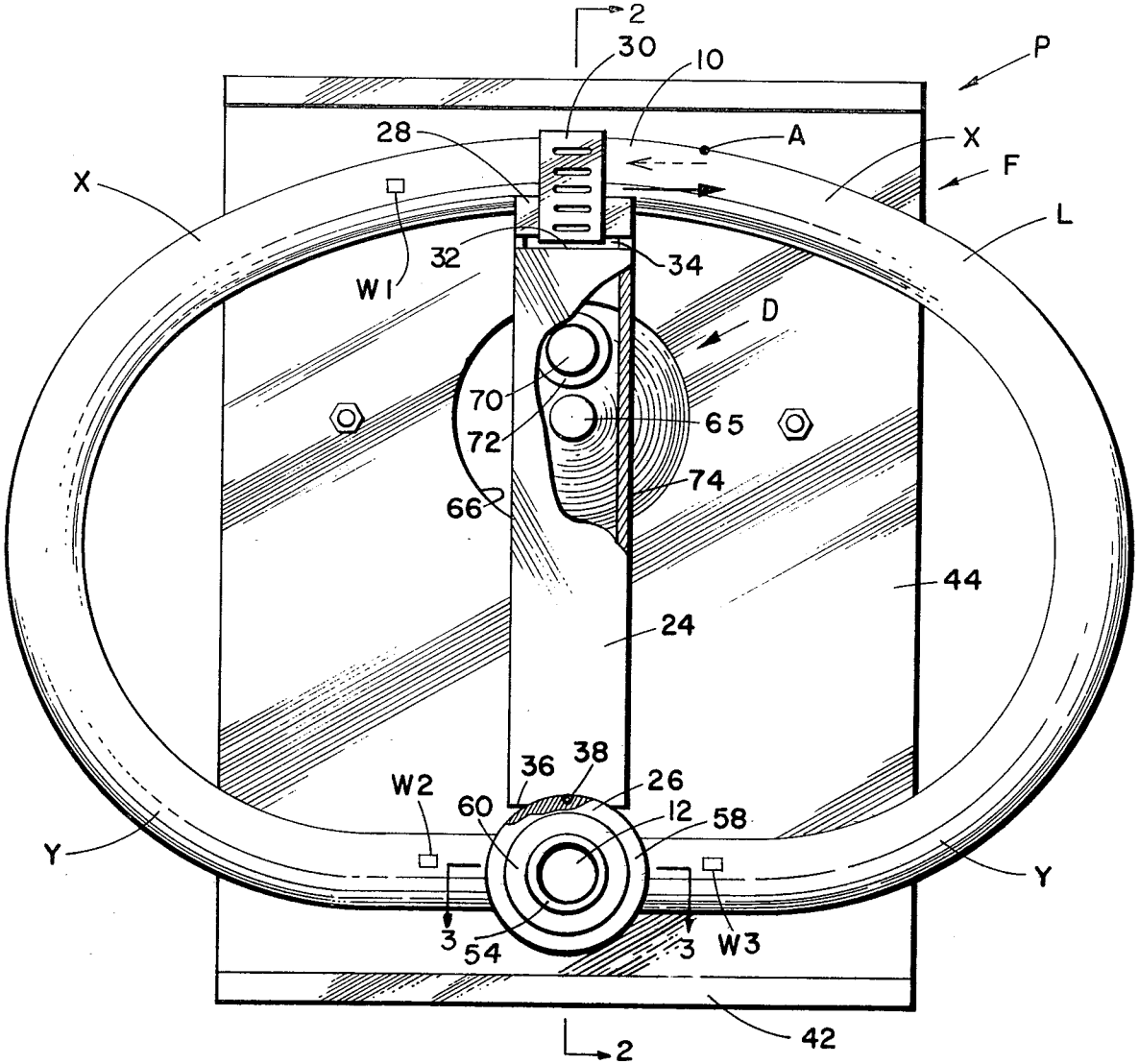
FIG. 1 is a front elevation of the rigid loop version of the pump, portions thereof having been broken away to reveal the interior construction.
Figure 2:
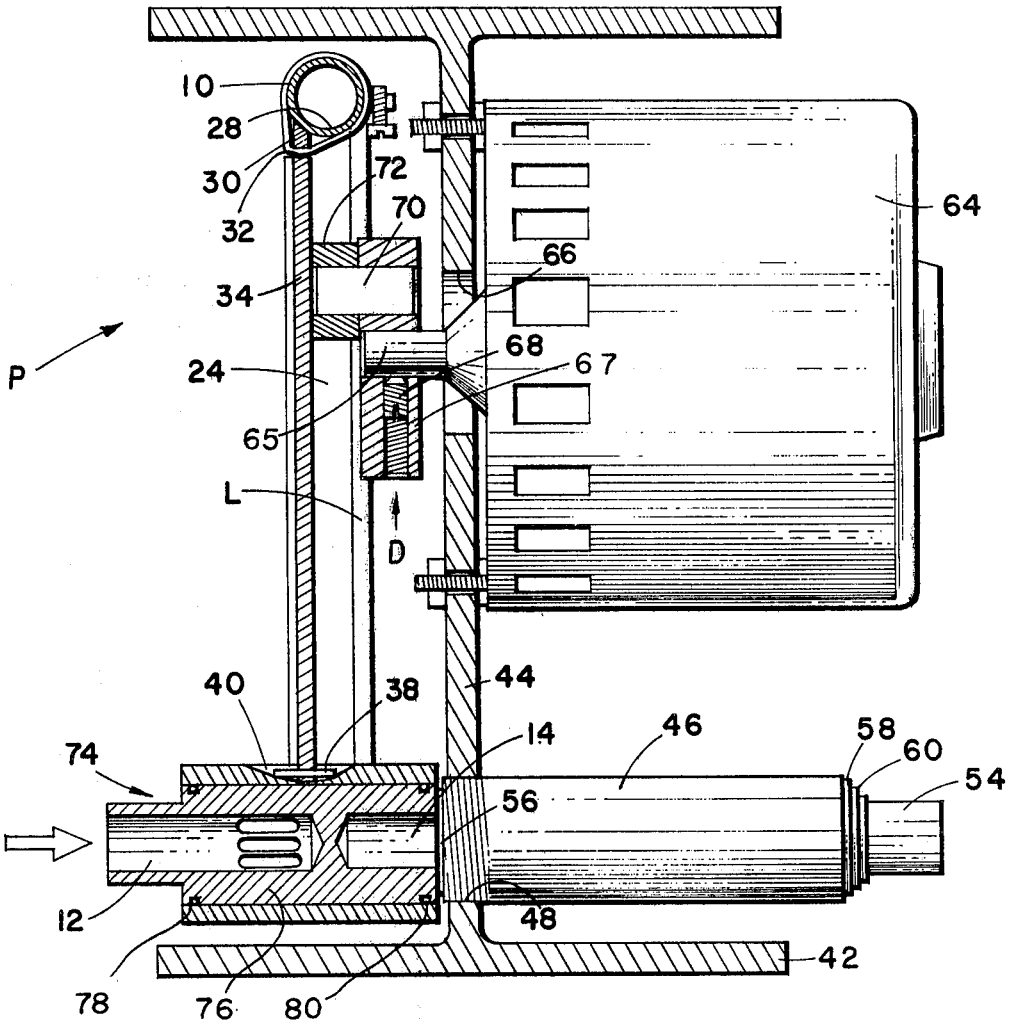
FIG. 2 is a vertical section taken along lines 2—2 of FIG. 1.
Figure 3:
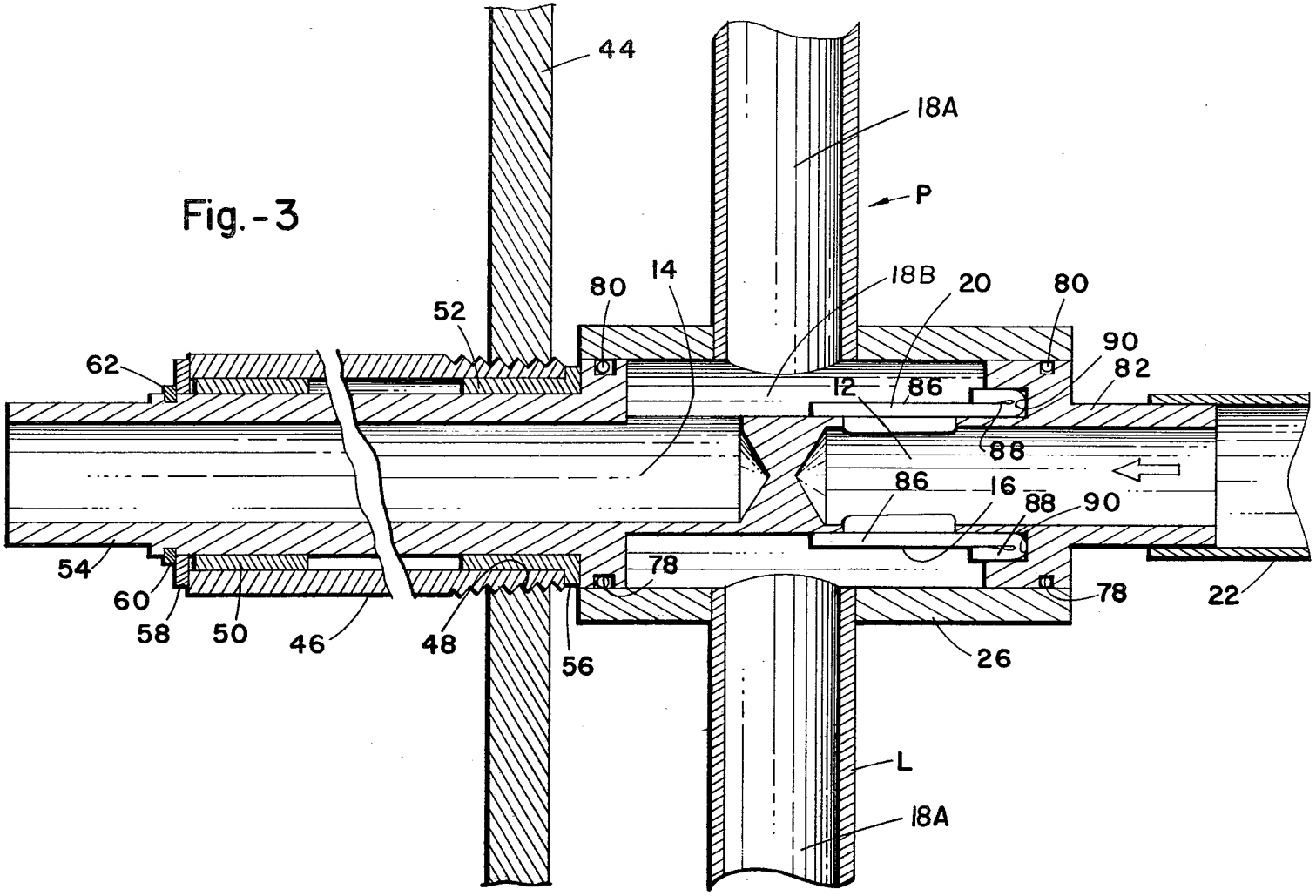
FIG. 3 is an enlarged fragmentary section taken along lines 3—3 of FIG. 1.

Referring next to FIGS. 1, 2 and 3 of the drawings for a detailed description of a rigid loop version "P" of the instant pump, reference character L has been chosen to designate the loop which when filled with a pumpable fluid and oscillated rapidly to and fro in the direction of fluid movement through the oscillated portion 10 thereof will take fluid from a suitable supply into its inlet 12 and discharge same under conditions of constant flow from its outlet 14. In the particular version illustrated, the inlet and outlet are axially aligned and their common axis defines the axis of oscillatory movement about which portion 10 of the loop L is oscillated, such axis being substantially normal to the plane of said loop. Positioned between the inlet and outlet of loop L is a first flow restricting means 16 which, in the particular form illustrated, comprises a simple flapper-type check valve. Inlet 12 is connected into loop L so as to cooperate therewith to define alternate flow paths 18A and 18B to the outlet 14 (FIG. 3). In the particular form shown, the first flow restricting means 16 is located within flow path 18A of the loop L while a second flow restricting means 20 is positioned in the other path 18B. Both of these flow restricting means 16 and 20 are responsive to fluid flow through their respective flow paths and automatically operative to inhibit reverse flow therein.

Bearing in mind the foregoing essential elements of the instant pump, its operation will now be described in connection with FIGS. 1 and 2. Consider initially that the entire loop L along with the supply line 22 carrying fluid to the inlet 12 and the discharge line (not shown) connected to withdraw same from the outlet 14 are filled. It will also be assumed that both flow restrictors 16 and 20 are closed. If tube 10 is now grasped at a point remote from its axis of pivotal movement and actuated so as to move point A on its surface to the right in the direction of the solid arrow in FIG. 1, water particle $W_1$ inside the tube wants to remain in place relative to the environment because of its mass. If, however, as has been assumed, first flow restricting means 16 is closed and effective to prevent or at least inhibit back flow within flow path 18A, then particle $W_1$ must move to the right along with point A. If flow is defined for present purposes at least as relative movement between the fluid in the loop L and the tube 10 of which the loop is formed, then no "flow" has yet taken place.

Next, however, consider that motion of point A is abruptly stopped. When this happens, the fluid within the tube represented by particle $W_1$ wants to keep moving to the right with the same velocity it had before due to its inertia. Flow as above defined is now taking place since the fluid represented by particle $W_1$ is now moving to the right relative to point A which is stationary. It is significant to note at this point that whenever flow in a forward direction is taking place because water particle $W_1$ is moving to the right relative to tube 10 and point A thereon, the first flow restricting means 16 will open to admit additional fluid to flow path 18A of the loop. At the same time, fluid exiting loop L at outlet 14 having flowed through flow path 18A will function to keep the second flow restricting means 20 closed and thus prevent reverse flow within alternate flow path 18B of the loop. The position of these two flow restrictors (check valves as shown) is, of course, dependent upon the differential fluid pressures on the upstream and downstream sides thereof to which forces they are automatically responsive.

To complete the oscillatory cycle, point A must be returned to its original position. As this takes place, fluid continues to flow as represented by particle $W_1$ at essentially the same rate relative to the environment but at a greatly increased rate relative to point A on tube 10 which is moving in the opposite direction.

With fluid thus flowing in a forward direction through flow path 18A of loop L, consider once again what happens when the first half of the oscillatory cycle is repeated, namely, moving point A to the right relative to the environment. As soon as point A moves faster than water particle $W_1$ inside the loop L, the differential fluid pressure across the first flow restrictor 16 will be such as to actuate the latter into its closed position thus preventing more fluid from entering flow path 18A by way of inlet 12. At the same time, however, the second flow restrictor 20 will be both pulled and pushed open by the inertial force of the fluid moving upstream and downstream thereof including those in the supply and discharge lines. When second fluid restrictor 20 opens, fluid will, of course, commence flowing from inlet 12 to outlet 14 through alternate flow path 18B. This condition will remain until the motion of point A to the right is abruptly stopped again and the fluid pressure on the downstream side of the first flow restrictor 16 becomes less than the downstream pressure on the second flow restrictor 20; whereupon, the former will reopen and the latter will close thus re-establishing the flow of fluid through flow path 18A and shutting it off within alternate flow path 18B. By this novel action, essentially constant flow results.

Looking specifically at FIG. 1 for the moment, it is important to realize that in the specific embodiment illustrated therein, not all of the loop L is contributing or "active" in the fluid pumping process. Instead, it is only that portion of the loop which, upon being oscillated, has a force acting thereon resolvable into a component extending in the direction of fluid movement therein that actively contributes to the pumping action. Conversely, that portion or those portions of the loop subject to forces that resolve into components at right angles to the movement of fluid therethrough are, for all practical purposes, useless insofar as what they contribute to the pumping action. As such, these portions function mainly as fluid communication channels.

It can thus be seen that the loop L shown has both "active" and what will be denominated here as "passive" portions, X and Y, respectively, for lack of a better term. The significance of these active and passive portions is that the energy of the fluid moving through the former must be used to accelerate the fluid in the latter so that all the fluid in the system moves together at the same velocity. It follows as a general principle of the instant pump that by maintaining as high a ratio as possible between the mass of fluid contained in the active portions of the system when compared with the passive portions thereof, the more nearly the overall velocity of fluid movement throughout the system will approach the maximum attainable within its active parts. In the particular pumps illustrated, both the rigid and flexible looped versions will exhibit about a 1:1 ratio of active to passive parts although it is possible to exceed this ratio significantly through the use of other somewhat more complicated designs that have not been illustrated.

As previously noted, despite what appears to be an alternate more or less "on-off" pumping cycle, quite unexpectedly the instant pump yields near constant flow. In other words, while the forces acting upon the fluid contained within the loop vary considerably over a complete cycle, at any given time there is always one of the flow restrictors open and fluid flowing in a forward direction through one of the alternate flow paths 18A or 18B. This fact coupled with the fact that at least one of the supply and/or discharge lines leading to or from the pump is at least several feet in length, the inertia of the whole system as just defined is so large that virtually no cycling effect is detectable at outlet 18.

Having thus discussed the operation of the pump of the present invention in terms of its broad essentials, attention will next be given to the specifics of the rigid loop version shown in FIGS. 1, 2 and 3 to which detailed reference will, once again, be made. Attached to the oscillated part of the loop L, preferably approximately midway between its ends, is a drive mechanism indicated broadly by reference numeral D which is operative upon actuation to oscillate such portion to and fro rapidly with a more or less reciprocating motion generally directed along the axis of fluid movement therethrough. Various conventional mechanisms effective to induce rapid oscillatory motion in the looped rigid conduit will suffice and, therefore, the drive as such forms no part of the novel aspects of the present invention. In the particular form illustrated, a rigid link 24 bisects the loop L from top to bottom with the lower end thereof being attached to the sleeve-like hollow manifold 26 that houses the flow restrictors 16 and 20 and into which opposite ends of loop L open. The upper end of link 24 is shaped to define a transversely-extending saddle 28 that seats the section of conduit diametrically opposite its axis of wobbling movement. As shown, the connection between the upper end of link 24 and the loop-forming conduit comprises a simple hose clamp 30. Link 24 in the particular form shown is generally channel-shaped and the aforementioned clamp 30 is reaved through horizontal slot 32 in the web 34 thereof. This same web is received in a transversely-extending portion 36 (FIG. 1) of an X-shaped slot in the wall of manifold 26. An axially-extending pin 38 carried on the lower end of link 24 is received in the axial portion 40 of the X-shaped slot. Using these rather basic connections, it becomes a simple matter to disassemble the pump.

As shown, the base 42 upon which the pump is mounted comprises a short section of I-beam with the web 44 thereof supporting all operative elements of the pump in an upright position. A stationary tubular hub 46 is threadedly attached within threaded hole 48 in the web and it, in turn, houses sleeve bearings 50 and 52 that journal the tubular extension 54 of manifold 26 for rotational movement. Bearing 52 is marginally flanged (56) on its front end while a washer 58 and a lock ring 60 seated within annular groove 62 on the rear end of extension 54 cooperate with one another and with the aforesaid flange to prevent axial movement of the manifold subassembly relative to the hub while permitting relative rotational movement therebetween. Hub 46, therefore, defines the axis of pivotal movement about which the loop L of rigid conduit oscillates.

In FIGS. 1 and 2, it can be seen that the oscillatory motion is imparted to loop L by means of a small fractional horsepower motor 64 bolted to web 44 of the base with its output shaft 65 projecting through opening 66 therein onto the front face thereof where the fluid-carrying elements of the pump are found. Shaft 65 mounts a crank-forming subassembly in the form of a disk 67 fastened concentrically to the shaft for rotation therewith by means of set screw 68 and an eccentric pin 70 displaced radially from the axis of motor shaft rotation. Pin 70 carries a bushing 72 on the front end thereof that is retained between the transversely-spaced marginal flanges 74 of link 24 for sliding movement in the direction of the length thereof. Thus, motor 65 becomes operative through crank subassembly 67, 70 and 72 to convert rotary to wobbling motion to link 24 and it, in turn, oscillates the fluid-filled loop of rigid conduit about the axis defined by hub 40.

In FIGS. 2 and 3 it can be seen that the manifold 26 comprises a hollow tubular member open at both ends which is fitted internally with a subassembly that has been indicated in a general way by reference numeral 74 and which encompasses many of the previously-described elements of the pump. The central section 76 thereof is cylindrical and defines a plug for manifold 26 effective to form fluid-tight seals at both open ends thereof, the latter comprising annular grooves 78 encircled by sealing rings 80. Extension 54 through which the pumped fluid is discharged forms a part of subassembly 74 and is formed integral therewith as is a similar extension 82 on the intake end through which fluid is taken into the loop. Extension 82 houses inlet 12 that leads through flow restrictors 16 and 20 to the loop L and to alternate flow path 18B, respectively. These flow restrictors in the particular form shown comprise nothing more than small rubber flapper elements 86 having one edge 88 doubled over on itself and wedged into grooves 90 in the central section of assembly 74. A pumpable fluid entering the pump will be discharged into loop L and circulate clockwise in FIG. 1 as it opens flow restrictor 16 at the inlet. As soon as the motion of loop L is such as to induce reverse flow in the loop, flow restrictor 16 will close and 20 will open bypassing the incoming fluid directly to outlet 14 through bypass 18. A 1/10 horsepower motor turning at 1800 rpm is capable of pumping water at a near constant rate of 5 gal/min. using a conduit having an i.d. of about $\frac{5}{8}$ inches formed into an eliptical loop having a minor diameter of around 7 inches and a major diameter of about $8\frac{1}{2}$ inches.

Figure 5:
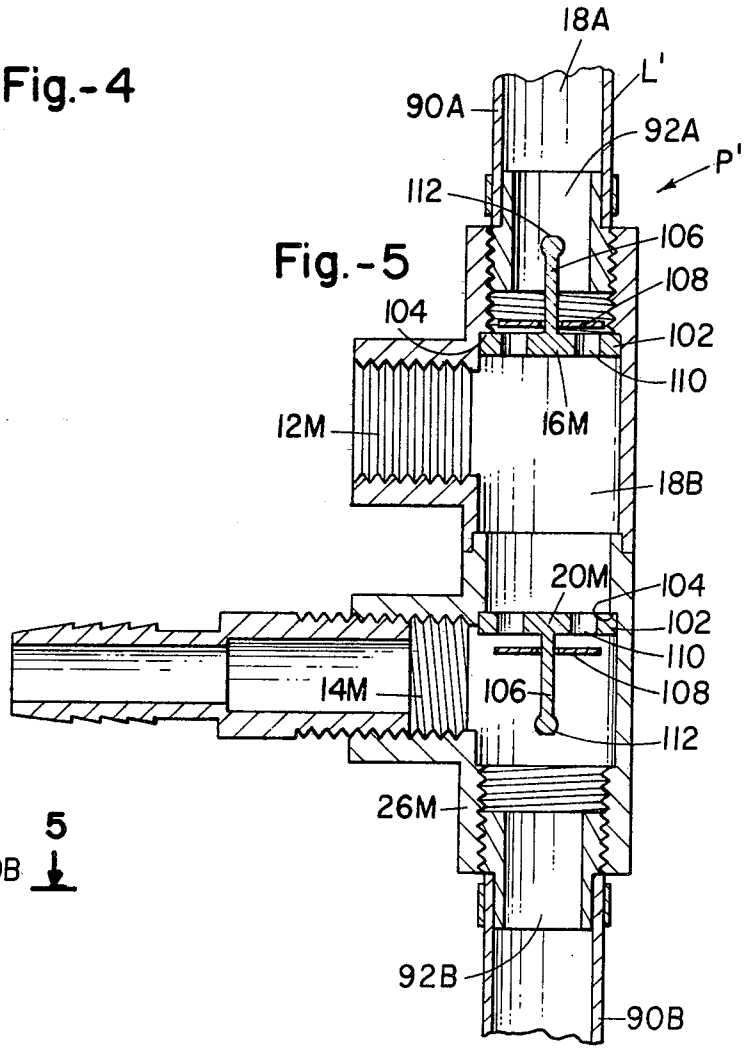
Figure 4:
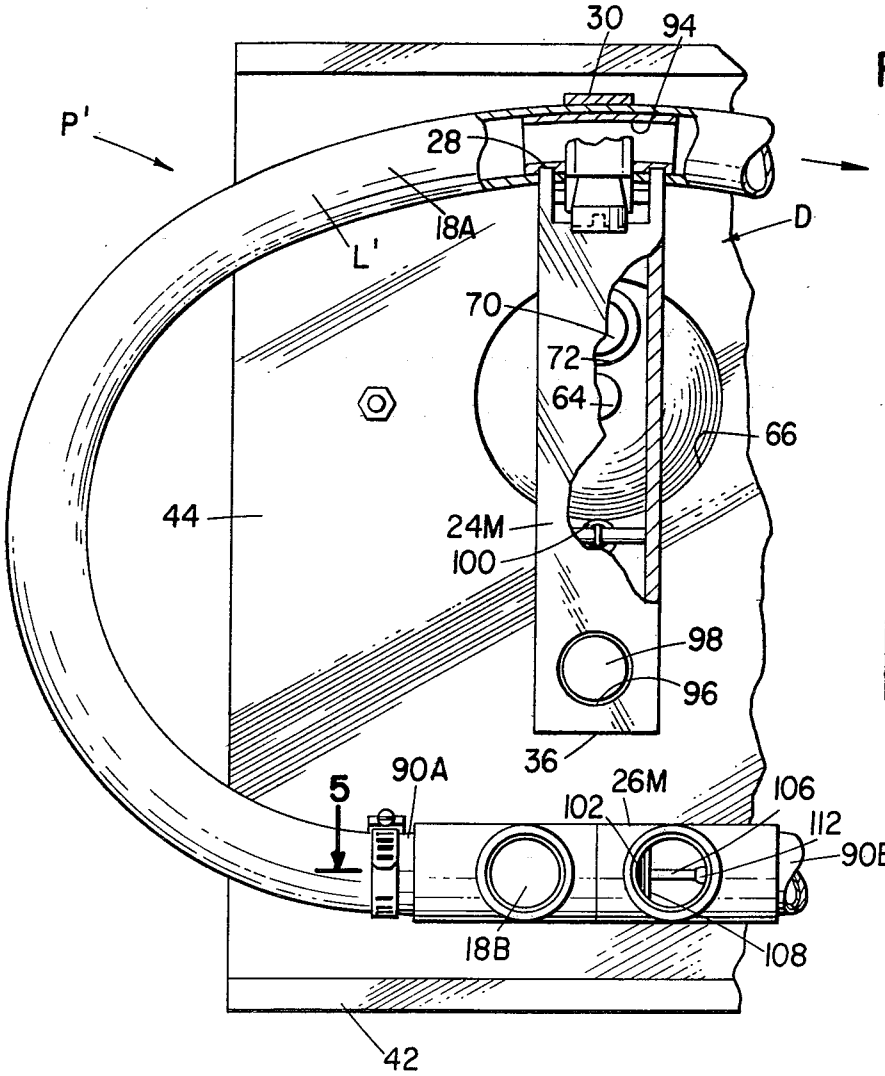
FIG. 4 is a fragmentary front elevation similar to FIG. 1 showing the flexible loop version of the pump with portions broken away to reveal the interior construction; and, FIG. 5 is a fragmentary diametrical section to an enlarged scale taken along line 5—5 of FIG. 4.

In FIGS. 4 and 5 to which detailed reference will next be made, an alternative flexible tubed version $P^1$ of the pump will now be described. The fluid-filled loop $L^1$ is, in this instance, made of a flexible material capable of withstanding the oscillatory motion imparted thereto by eccentric 70 when the inlet end thereof 90A along with its discharge end 90B are clamped, cemented or otherwise attached to opposite open ends 92A and 92B of rigid tubular manifold 26M. Pump $P^1$, therefore, differs from pump P of the previously described version in that the oscillatory motion of the latter was taken up by a torsionally flexible supply line, discharge line, or both; whereas, in the former, this selfsame oscillatory motion is taken up by the loop itself, $L^1$.

In the particular arrangement shown, a short section of rigid tubing 94 is inserted into the flexible tube at the point where clamp 30 encircles same to prevent the tube from collapsing. The minimal restriction provided by such an insert is inconsequential. A slightly modified frame is used with this version in which the manifold 26M is rigidly attached to the web 44 thereof just above the base 42 and in horizontally disposed position with both its inlet 12M and its outlet 14M opening forwardly in side-by-side relation. Link 24M has its upper end 28 clamped to the flexible tube in the manner already mentioned, however, its lower end is apertured at 96 to receive pivot pin 98 projecting forwardly from web 44 of the frame at a point spaced well beneath the circular path described by eccentric 70 of motor drive D. In the particular form shown, a small tension spring 100 connected between opposed surfaces on the rear face of link 24M and the front face of web 44 detachably holds the link and pivot in assembled relation. Other means of attaching these elements together for relative oscillatory movement can, of course, be used. In fact, an arrangement very similar to the rigid tube version of FIGS. 1, 2 and 3 could be used provided the lower end 36 of the link 24 was mounted atop manifold 26 so as to be able to tilt from side-to-side about pin 38 as a fulcrum. Be that as it may, these are incidentals well within the skill of an ordinary artisan and, as such, they form no part of the present invention.

Manifold 26M houses modified first and second flow restricting means 16M and 20M which comprise simple check valves each having an apertured seat 102 that is cemented in place against an annular shoulder 104 provided for this purpose inside each open end 92A and 92B of the manifold. An axially-extending integrally-formed post 106 projects downstream and mounts a centrally-apertured valve element 108 that functions to close off the holes 110 in the seat whenever reverse flow takes place in their respective alternate flow paths 18A and 18B of loop $L^1$. The free end of post 104 is enlarged as shown at 112 to retain valve element 106 thereon.

Functionally, the pump of FIGS. 4 and 5 is no different than that which has been previously described in connection with FIGS. 1, 2 and 3. At such time as a point on section 10 of loop $L^1$ moves to the right in the direction of the solid arrow of FIG. 4 at a rate faster than a water particle inside thereof, flow restrictor 16M will automatically actuate into closed position thus preventing reverse flow in flow path 18A. At the same time, the fluid acting on flow restrictor 20M will function to open the latter permitting fluid entering inlet 12M to pass immediately to outlet 14M through alternate flow path 18B without traversing the loop $L^1$ and the flow path 18A defined thereby.

What is claimed is:

1. In an inertia pump: means defining a fluid-containment loop having at least a portion thereof capable of being oscillated to and fro relative to the environment in the direction of fluid movement therethrough, an inlet connectable to a source of pumpable fluid connected into said fluid containment loop for delivering fluid thereto and an outlet connected to receive fluid therefrom, said inlet and outlet connections cooperating to segment said loop and divide the interior thereof into first and second alternate fluid flow paths therebetween, first flow control means located within the first fluid flow path responsive to the flow of fluid therethrough and automatically operative to inhibit reverse flow while permitting free forward flow, second flow control means located in the second fluid flow path responsive to the flow of fluid therethrough and automatically operative to inhibit reverse flow while permitting free forward flow, and means connected to said oscillatable portion of the fluid-containment loop for oscillating same relative to its surroundings in the direction of fluid movement therethrough, said first and second flow control means cooperating when said loop is thus oscillated to maintain an uninterrupted flow of fluid between said inlet and outlet, fluid flowing from said inlet to said outlet by passing completely through both of said first and second alternate flow paths on an alternating basis.

2. The pump of claim 1 wherein the inlet receives fluid in a direction essentially perpendicular to its flow within the loop.

3. The pump of claim 1 wherein the outlet discharges fluid in a direction essentially perpendicular to its flow within the loop.

4. The pump of claim 1 wherein the inlet and outlet are arranged coaxially.

5. The pump of claim 1 wherein the inlet and outlet are arranged in side-by-side relation.

6. The pump of claim 1 wherein the loop is rigid and the inlet connection is flexible and adapted to accommodate oscillation of said loop.

7. The pump of claim 1 wherein at least one portion of the loop is rigid and a second portion is flexible, the inlet and outlet connections are made within one of said rigid portions, the means for oscillating the loop is connected to the loop at a point remote from said inlet and outlet connections, and said flexible portion is adapted to accommodate the bending between it and said rigid portion or portions occasioned by such oscillation.

8. The pump as set forth in claim 1 wherein said first and second flow control means comprise check valves.

9. The pump as set forth in claim 2 wherein said inlet connection is torsionally flexible and adapted to accommodate the oscillatory motion imparted to the loop.

10. The pump as set forth in claim 3 wherein said outlet connection is torsionally flexible and adapted to accommodate the oscillatory motion imparted to the loop.

* * * * *